United States Patent [19]

Rankel

[11] 4,424,118

[45] Jan. 3, 1984

[54] METHOD FOR REMOVING CONTAMINANTS FROM HYDROCARBONACEOUS FLUID

[75] Inventor: Lillian A. Rankel, Princeton, N.J.

[73] Assignee: Mobil Oil Corporation, New York, N.Y.

[21] Appl. No.: 326,257

[22] Filed: Dec. 1, 1981

[51] Int. Cl.[3] ..... C10G 29/02; C10G 45/02

[52] U.S. Cl. ..... 208/211; 208/251 R; 208/254 R; 208/289

[58] Field of Search ..... 208/251 R, 211, 289, 208/293, 207, 236, 254 R, 11 LE

[56] References Cited

U.S. PATENT DOCUMENTS

| | | | |
|---|---|---|---|
| 2,778,779 | 1/1957 | Donaldson | 208/88 |
| 2,973,316 | 2/1961 | Howland | 208/254 R |
| 3,052,620 | 9/1962 | Hanson | 208/11 |
| 3,093,574 | 6/1963 | Bertolacini et al. | 208/91 |
| 3,250,697 | 5/1966 | Walters et al. | 208/207 |
| 3,536,619 | 10/1970 | Urban et al. | 208/254 R |
| 4,029,571 | 6/1977 | Curtin | 208/251 H |
| 4,203,830 | 5/1980 | Rollmann et al. | 208/236 |
| 4,224,142 | 9/1980 | Benedict | 208/179 |
| 4,233,138 | 11/1980 | Rollmann et al. | 208/106 |

*Primary Examiner*—Delbert E. Gantz
*Assistant Examiner*—O. Chaudhuri
*Attorney, Agent, or Firm*—Charles A. Huggett; James F. Powers, Jr.; John K. AboKhair

[57] ABSTRACT

The present invention relates to a method for removing contaminants such as arsenic from a hydrocarbonaceous fluid which consists essentially of the crude, or a fraction thereof, obtained from oil shale, solid coal, or tar sands by non-catalytically heat treating the hydrocarbonaceous fluid at a temperature of from about 20° F. to about 600° F. in the presence of an aqueous solution containing an agent that would convert such contaminants into components soluble in the aqueous solution. Particularly suitable agents to be utilized in the above aqueous solution to remove contaminants such as arsenic are ammonium sulfide type compounds. The purified hydrocarbonaceous fluid may be subjected to a catalytic hydrotreating process.

21 Claims, 1 Drawing Figure

SCHEME FOR AMMONIUM SULFIDE WASHING OF SHALE OIL TO REMOVE ARSENIC FOLLOWED BY HYDROTREATING

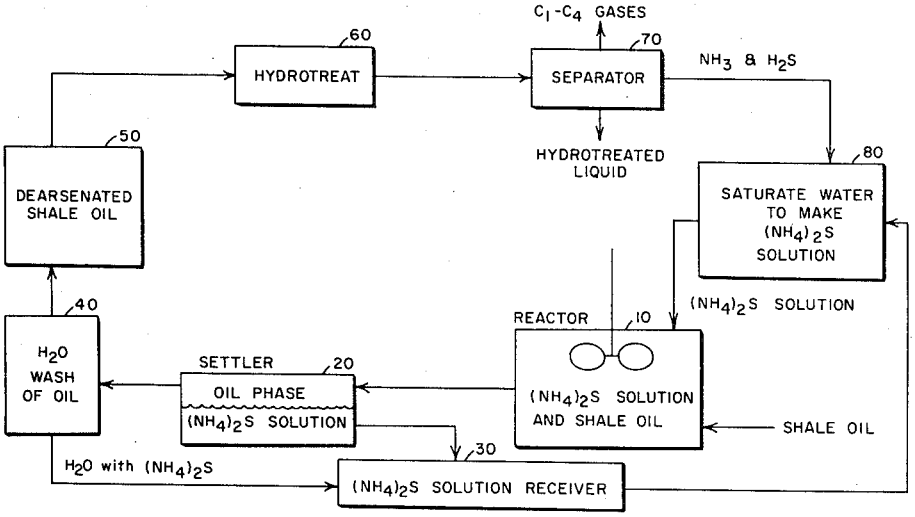

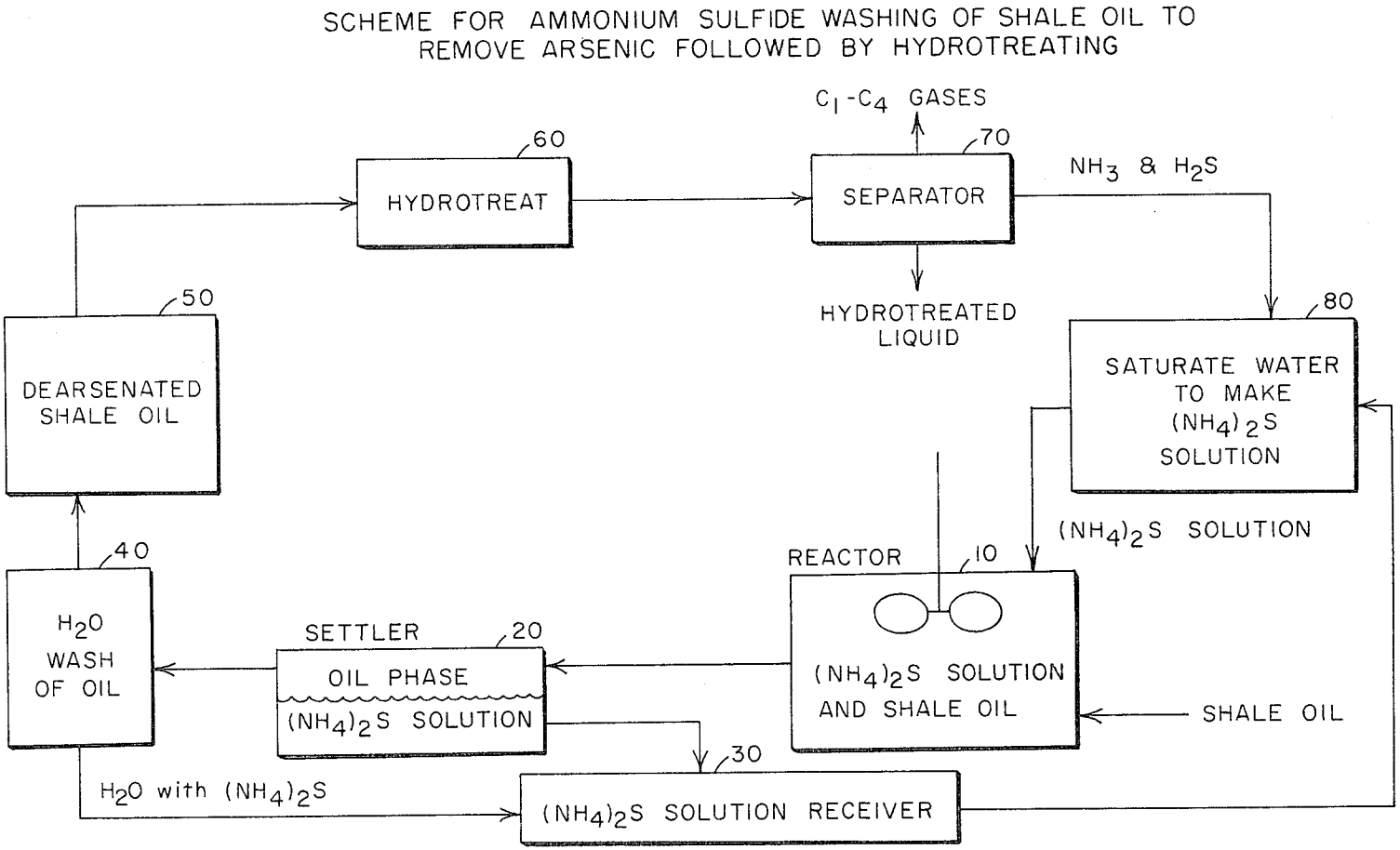
SCHEME FOR AMMONIUM SULFIDE WASHING OF SHALE OIL TO REMOVE ARSENIC FOLLOWED BY HYDROTREATING
80
SATURATE WATER TO MAKE $(NH_4)_2S$ SOLUTION
$NH_3$ & $H_2S$
70
SEPARATOR
$C_1$-$C_4$ GASES
HYDROTREATED LIQUID
60
HYDROTREAT
50
DEARSENATED SHALE OIL
$(NH_4)_2S$ SOLUTION
SHALE OIL
10
REACTOR
$(NH_4)_2S$ SOLUTION AND SHALE OIL
20
SETTLER
OIL PHASE $(NH_4)_2S$ SOLUTION
40
$H_2O$ WASH OF OIL
30
$(NH_4)_2S$ SOLUTION RECEIVER
$H_2O$ with $(NH_4)_2S$

METHOD FOR REMOVING CONTAMINANTS FROM HYDROCARBONACEOUS FLUID

FIELD OF THE INVENTION

This invention relates to a method for treating hydrocarbonaceous fluids, such as synthetic crude oils. In another aspect, this invention relates to a method for removing contaminants, such as arsenic, from a hydrocarbonaceous fluid, such as synthetic crude oil. In still another aspect, this invention relates to a noncatalytic method for removing contaminants, such as arsenic from a hydrocarbonaceous fluid.

BACKGROUND OF THE INVENTION

Recent economic and political developments have resulted in dramatic increases in the cost of energy sources such as conventional crude oil and the like. As a result of the increased prices of crude oil and as a result of real and potential shortages of crude oil, various alternative sources of energy are being investigated. It has long been known that there are many alternative sources of energy available but such sources have not been economically competitive with conventional crude oil. Now, it is apparent that the formerly noncompetitive sources of energy will be used to supply an increasing portion of our energy needs in the future. Some of the more promising sources of energy that will be used in the future include hydrocarbonaceous fluids obtained from oil shale, normally solid coal, tar (including tar sands) and the like. Often, these hydrocarbonaceous fluids are referred to under generic terms such as "synthetic crude oil," or "synthetic oil fractions."

The above-mentioned hydrocarbonaceous fluids contain contaminants that affect their ability to be readily processed into satisfactory sources of energy and precursors for the synthesis of other desired materials. For example, the above-mentioned hydrocarbonaceous fluids contain contaminants that tend to interfere with refining and chemical processes such as hydrogenation processes and in some instances they may poison or inactivate catalysts used in such processes. Particularly troublesome contaminants found in such hydrocarbonaceous fluids include arsenic and arsenic compounds. Even if the above-mentioned hydrocarbonaceous fluids are employed directly as fuels, the removal of such contaminants may be desirable from an environmental protection standpoint. Thus, it is desirable that such contaminants be removed or reduced to low concentrations in the hydrocarbonaceous fluids before they can be processed or utilized as fuels.

The prior art is replete with various methods for removing contaminants such as arsenic from hydrocarbon feedstocks. For example, U.S. Pat. No. 2,778,779 discloses a method for removing arsenic from hydrocarbon fractions by using iron, nickel and cobalt oxides as oxidizing agents to oxidize arsenic to a water soluble arsenic oxide. Thereafter, the arsenic oxide is dissolved and removed from the naturally occurring crude oil or oil fraction thereof.

Other methods for removing contaminants such as arsenic from hydrocarbon fractions include catalytic treatment methods such as those disclosed in U.S. Pat. No. 3,662,498 wherein a crude oil having a high metals content is treated in the presence of hydrogen and a slurry of a catalytic metal material to remove the contaminants therefrom.

Sophisticated treatment methods such as disclosed in U.S. Pat. No. 3,496,099 have been utilized to remove contaminants from hydrocarbon fractions by means of a hydrogen treatment method in a catalyst bed which has increasing hydrogenation catalytic activity throughout the bed.

A noncatalytic treatment to remove contaminants from hydrocarbonaceous fluids is disclosed in U.S. Pat. No. 4,029,571. The patent teaches the precipitation of the contaminants through a noncatalytic heat treating process in the presence of hydrogen, such as a hydrovisbreaking step. After the heat treating step the, precipitated contaminants are separated from the hydrocarbonaceous fluids utilizing conventional separation means.

The above methods of contaminants removal which include the use of alumina filled guard chambers, clay-silica-alumina guard chambers upstream from hydroprocessing, caustic washing, or oxidizing type reagent treatments (hydroperoxides), have certain drawbacks. Guard chambers must be replaced often. Caustic washing can leave alkali or alkaline earth metals in the shale oil which can subsequently deactivate down stream catalysts. Extensive water washing after caustic treatment generates large quantities of arsenic-containing aqueous effluents with associated disposal problems. Oxidizing reagents can increase the oxygen-content of shale oil as well as cause polymerization reactions. The search for other methods of arsenic removal is therefore desirable.

Accordingly, the present invention provides a method for removing contaminants such as arsenic from hydrocarbonaceous fluids utilizing solutions of ammoium sulfide type compounds.

SUMMARY OF THE INVENTION

Accordingly, it is an object of this invention to provide a new and improved process for treating hydrocarbonaceous fluids. It is another object of this invention to provide a new and improved process for removing contaminants from hydrocarbonaceous fluids. It is still a further object of this invention to provide a new and improved noncatalytic treatment method for removing contaminants such as arsenic from hydrocarbonaceous fluids.

The present invention provides a method for removing contaminants such as arsenic from a hydrocarbonaceous fluid which consists essentially of the crude, or a fraction thereof, obtained from oil shale, solid coal, or tar sands by noncatalitically heat treating the hydrocarbonaceous fluid at a temperature of from about 20° F. to about 600° F. in the presence of an aqueous solution of ammonium sulfide type compounds. The heat treatment is applied for a time sufficient to convert at least some of the contaminants in the hydrocarbonaceous fluid to components selected from the class consisting of those extractable in a solution of ammonium sulfide type compound. The thus treated synthetic hydrocarbonaceous fluid can then be subjected to a separation step wherein at least a portion of the extractable contaminant components are remove. The treated hydrocarbonaceous fluid will have a reduced contaminant level when compared with untreated hydrocarbonaceous fluid.

Solutions of ammonium sulfide type compounds are advantageous because they are basic, contain no alkali or alkaline earth metals, are volatile, and easily decompose to hydrogen sulfide and ammonia. Thus, any ammonium sulfide type compounds residue in the hydrocarbonaceous fluids can be easily removed during thermal processing.

Other aspects, objects and advantages of this invention will be apparent to those skilled in the art from the following disclosures and appended claims.

BRIEF DESCRIPTION OF THE DRAWING

The drawing shows a flow diagram of an embodiment of the invention.

DETAILED DESCRIPTION OF THE INVENTION

In the following description and examples, the invention will be described in connection with the removal of arsenic from hydrocarbonaceous fluids. However, it should be clear that the invention is applicable to the removal of other contaminants that are capable of forming water extractable components when subjected to the treatment in accordance with the present inventions. Other contaminants which are desirable to remove from synthetic hydrocarbonaceous fluids include selenium, iron, cobalt, molybdenum, calcium, strontium, zinc, nickel, cadmium, and silicon.

It will be understood that the terms "arsenic" and "arsenic components" as used herein include arsenic in whatever forms, elemental or combined, it may be present. Also, all feedstock and product oil arsenic concentrations are herein calculated by weight as elemental arsenic.

The hydrocarbonaceous fluids that are treated in accordance with this invention are hydrocarbonaceous fluids obtained from oil shale, normally solid coal, tar (including tar sands) and fractions thereof. This invention applies to the treatment of the full range of hydrocarbonaceous fluids, including whole crude and fractions thereof from residuals or bottoms fractions to overhead fractions obtained by retorting and the like. In some instances, the hydrocarbonaceous fluids may be referred to as synthetic crude or synthetic oil fractions. The art is replete with methods for converting coal to hydrocarbonaceous fluids. A summary of the well known processes for such conversion is found in U.S. Pat. No. 4,267,033 to Heck et al which is hereby incorporated by reference. U.S. Pat. No. 4,032,428 to Farcasio et al, which is hereby incorporated by reference, relates to a method for obtaining hydrocarbonaceous fluids from tar sands. An excellent summary of the art of obtaining hydrocarbonaceous fluids from coal, oil shale, and tar sands is given in Encyclopedia of Chemical Technology, Edited by Kirk-Othmer, Third Edition, Volumn 11, pages 447–576, (1980), Interscience Publishers, New York N.Y., the contents of which are herein incorporated by reference. The hydrocarbonaceous fluids described above are known to contain arsenic impurities or contaminants as well as other impurities or contaminants. Arsenic concentrations in these materials normally exceed about 20 ppm and will vary, for example, from about 20 to about 80 ppm for shale oils and from about 20 to about 1200 ppm for coal and tar distillates.

One aspect of the present invention can be most conveniently described by referring to the drawing which depicts a scheme for ammonium sulfide washing of shale oil to remove arsenic followed by hydrotreating. A shale oil feed stream is introduced into a heat treatment extraction reactor zone 10. Aqueous ammonium sulfide solution is added to the shale oil in the extraction reactor zone 10. A mechanical stirrer may be utilized to mix the two fluids as they are subjected to heat treatment of from about 20° F. to about 600° F. Applicable extraction systems include but are not limited to single contact, simple multistage contact, countercurrent multistage contact, continuous countercurrent differential contact, and batch countercurrent multistage extraction. The above systems are described in R. H. Perry and C. H. Chilton, Chemical Engineers' Handbook, 5th Ed. McGraw Hill, N.Y. (1973), Section 15. Data indicates that good contacting, as could be obtained by countercurrent methods, improves arsenic removal. The heat treated fluids are removed from the reactor zone 10 into a settling zone 20 where the fluids are allowed to settle and separate into two phases, an aqueous phase and an oil phase. Alternatively, any liquid-liquid separation process or equipment may be applied to zone 20. The aqueous phase contains the excess ammonium sulfides and at least some of the shale oil feed stream arsenic that has been converted into ammonium sulfide solution soluble forms, while the oil phase contains a reduced amount of contaminants.

The bottom aqueous phase is removed from the settler zone 20 into an ammonium sulfide solution receiver 30. The oil phase from the settler zone 20 is removed into a wash zone 40 where the oil is subjected to an aqueous wash to further remove the water soluble arsenic components. The fluids are again allowed to settle and the aqueous phase is removed from the wash zone 40 into the ammonium sulfides solution receiver 30. The dearsenated shale oil is removed from the wash zone 40 into a holding zone 50 where any residual traces of ammonium sulfide are quickly decomposed at low temperature to gaseous ammonia and gaseous hydrogen sulfide.

The dearsenated shale oil is transferred from holding zone 50 to a hydrotreat zone 60 where the shale oil is subjected to a catalytic hydrotreating process and subsequently removed from the hydrotreat zone 60 to a separator zone 70. In the separator zone the hydrotreated liquid is separated from the $C_1$ to $C_4$ gases. Additionally, when shale oils are hydrotreated, gaseous ammonia and gaseous hydrogen sulfide are produced.

When shale oils are hydrotreated, about twice as much gaseous ammonia is produced as gaseous hydrogen sulfide. This stoichiometry is ideal for the formation of ammonium sulfide.

$$2\ NH_3 + H_2S \rightarrow (NH_4)_2S$$

Thus the ammonia and hydrogen sulfide produced from the hydrotreating of the shale oil and separated in the separator zone 70 are dissolved in water to form an ammonium sulfide solution in zone 80. This ammonium sulfide solution of zone 80 may be used as the ammonium sulfide solution originally added to the shale oil feed stream in reactor zone 10.

Ammonium sulfide type compounds are suitable for application in the present invention. The compounds include, but are not limited to, ammonium polysulfides ($(NH_4)_2S_x$), ammonium sulfide ($(NH_4)_2S$), ammonium hydrogen sulfide ($NH_4HS$) or any combination thereof. An advantage of the above compounds is that they can be quickly decomposed at low temperature to gaseous ammonia and gaseous hydrogen sulfide prior to catalytic hydrotreating thus avoiding contamination of the catalyst. Another advantage in using the ammonium sulfide type compounds in the process of the present invention is that these compounds can be made from gaseous ammonia and hydrogen sulfide which are abundant by-products of the catalytic hydrotreating process. The processes of making ammonium sulfide type compounds from gaseous ammonia and gaseous hydrogen sulfide are well known in the art as evidenced in the article by W. H. Lee and M. F. C. Ladd, Inorganic and Theoretical Chemistry, Vol. VII, Supplement, I, 469–472, which is hereby incorporated by reference. In heat treating the synthetic hydrocarbonaceous fluids according to this invention, any conventional methods for applying heat to the fluids can be utilized. Thus, conventional heat exchangers, furnaces and other vessels can be utilized to supply the necessary heat to the synthetic hydrocarbonaceous fluids for the heat treating step of this invention. Normally, the heat treating step can be carried out at a temperature of from about 20° F. to about 600° F., preferably, the temperature for carrying out the heat treating step will be from about 200° F. to about 400° F.

The length of time that the hydrocarbonaceous fluids are maintained at the elevated temperatures during the heat treating step will vary according to the temperature as well as the amount of cracking and coking that can be tolerated during the heat treating step. When the hydrocarbonaceous fluid is heat treated at rather mold temperature conditions, the length of time for the heat treating step will probably be longer than when the heat treating step is carried out at a higher temperature.

Following the heat treating and separation steps to remove at least a portion of the arsenic contaminants, the hydrocarbonaceous fluid, having reduced impurity levels, can be refined, treated or used in any desirable manner. Because of the low levels of arsenic contamination, the treated products produced with this invention are particularly applicable to subsequent refining and/or treatment steps wherein operations would be impaired if the arsenic contaminants were present. Catalytic hydrotreatment is such a subsequent refining step where the presence of arsenic would impair the process by contaminating the catalyst.

While the foregoing process has been described in terms of a noncatalytic process, it will, of course, be appreciated that it can be used in conjunction with catalytic processes wherein the feed stream can be catalytically treated before the heat treating step or the heat treatment hydrocarbonaceous fluid can be catalytically treated before the separation step.

It will, of course, be understood that the above-described process for removing arsenic contaminants from synthetic hydrocarbonaceous fluids can be carried out on either a batch or continuous scale.

EXAMPLES

The elemental analyses and properties of the shale oil feed are listed in Table 1, the Experiments that were conducted with shale oil are compiled in Table 2. Aqueous ammonium sulfide solution, produced by Mallinkrodt to contain 22 wt. % of ammonium sulfide, was used for arsenic removal. A Branson sonifier, operating at 150 watts, mixed the shale oil either with ammonium sulfide solution or water. The tube reactor was ¼ in. o.d. stainless steel tube (8 ft, long and coiled) packed with 14/20 mesh vycor. The shale oil was fed to the reactor with an Isco pump at 50 cc/hr., $(NH_4)_2S$ solution or water at 20 cc/hr. and $H_2$ at 500 cc/min. The reactor was maintained at 500° F. in a fluidized bath. The charcoal treatments followed the $(NH_4)_2S$ solution or water treatments and consisted of stirring 20 g of activated charcoal with the treated shale oil at 60° C. for 1 hr, and then suction filtering to remove the charcoal. A glass bead packed distillation column under vacuum conditions was used to separate the shale oil into 650° F.−and 650° 1 F.+fractions.

TABLE I

| SHALE OIL FEED | | |
|---|---|---|
| | % C | 84.46 |
| | H | 11.03 |
| | N | 2.17 |
| | O | 1.38 |
| | S | 0.73 |
| | ppm As | 32 |
| IBP–420° F. | 4.50% | 9 ppm As (IBP–650° F.) |
| 420–650 | 31.17% | |
| 650–850 | 32.96% | 43 ppm As (650–1075° F.+) |
| 850–1075 | 17.74 | |
| 1075+ | 13.66 | |

TABLE 2

CONDITIONS USED FOR TREATING SHALE OIL

| | Solution Used | Vol. Oil: Vol. Sol. | Method of Contact | Temp. F. | Time Hrs. | ppm As |
|---|---|---|---|---|---|---|
| Feed | | | | | | 32 |
| A | $(NH_4)_2S$ | 3:1 | Stir | 300 | 0.5 | 10 |
| B | $H_2O$ | 3:1 | Stir | 300 | 0.5 | 19 |
| C | $(NH_4)_2S$ | 4:1 | Stir (weekend) | 150 | 60 | 8 |
| D | $H_2O$ | 4:1 | Sir (weekend) | 150 | 60 | 12 |
| E | $(NH_4)_2S$ | 3:1 | Sonification (1) | 150 | 0.5 | 15 |
| F | $(NH_4)_2S$ | 3:1 | 2nd time | 150 | 0.5 | 5 |
| G | $(NH_4)_2S$ | 3:1 | 3rd time | 150 | 0.5 | 5 |
| H | $(NH_4)_2S$ | 2:1 | Sonified with two successive solutions | 150 | 0.35 | 9 |
| I | $H_2O$ | 3:1 | Sonification | 150 | 0.5 | 15 |
| J | $H_2O$ | 3:1 | 2nd time | 150 | 0.5 | 15 |
| K | $(NH_4)_2S$ | 3:1 | Tube Reactor (500 psig) | 500 | 0.7 | 7 |
| L | $H_2O$ | 3:1 | Tube Reactor (500 psig) | 500 | 0.7 | 38 |
| M | $(NH_4)_2S$ | 4:1 | Stir and charcoal treat | 150 | 24 | 9 |
| N | $H_2O$ | 4:1 | Stir and charcoal treat | 150 | 24 | 20 |

(1) 6 five-minute bursts of sonification were used at 15 minute intervals.

TABLE 3

ELEMENTAL ANALYSES OF PRODUCTS

| | Total Liquid | | | | 650° F.− | | | 650° F.+ | | |
|---|---|---|---|---|---|---|---|---|---|---|
| | N | S | As | % deAs | N | S | As | N | S | As |
| Feed | 2.17 | 0.73 | 32 | — | 1.41 | 0.89 | 9 | 2.38 | 0.70 | 43 |
| A | 2.25 | 1.38 | 10 | 69 | — | — | 2 | 2.34 | 1.23 | — |
| B | 2.16 | 0.70 | 19 | 41 | — | — | — | — | — | — |
| C | 2.28 | 1.03 | 8 | 75 | 1.26 | 0.92 | 2 | 2.38 | 0.87 | 10 |
| D | 2.14 | 0.78 | 12 | 63 | 1.30 | 0.89 | 3 | 2.28 | 0.74 | 14 |
| E | 2.31 | 0.85 | 15 | 53 | — | — | — | — | — | — |
| F | 2.32 | 0.93 | 5 | 84 | — | — | — | — | — | — |
| G | — | — | 5 | 84 | — | — | — | — | — | — |
| H | 2.31 | 0.93 | 9 | 72 | — | — | 2 | — | — | 14 |
| I | 2.18 | 0.72 | 15 | 53 | — | — | — | — | — | — |
| J | 2.18 | 0.72 | 15 | 53 | — | — | — | — | — | — |
| K | 2.04 | 0.95 | 7 | 78 | 1.14 | 0.86 | 2 | 2.18 | 0.77 | 9 |
| L | — | — | 38 | 0 | 1.22 | 0.93 | 9 | 2.25 | 0.74 | — |
| M | 2.30 | 0.97 | 9 | 72 | — | — | 2 | — | — | 10 |
| N | 1.99 | 0.74 | 20 | 38 | — | — | 5 | — | — | 28 |

In all the arsenic extractions studied here, ammonium sulfide solution removed signifcantly more arsenic than did water, as shown in Table 3. Good contact, between the ammonium sulfide solution and shale oil, and temperature play an important role in arsenic removal.

Compare, for example, (A) (300° F./0.5 hrs. stirring) which gives a liquid with 10 ppm arsenic with (E) (150° L F., 0.5 hrs., sonification) which gives 15 ppm arsenic. Successive sonifications, (F) or greater ammonium sulfide solution to oil ratio (H) which improve oil contact, would tend to remove more arsenic. 5 ppm arsenic are found in the (F) run that was sonified with two successive batches of $(NH_4)_2S$ solution. A mixture of $(NH_4)_2S$ solution and shale oil processed at 500° F. and 500 psig (K) yielded results comparable to successive sonifications. This is probably due to the good mixing obtained in the packed tube plus solubilization of some of the $(NH_4)_2S$ due to pressure and subsequent reaction with arsenic compounds.

Arsenic analyses for the 650° F.− and 650° F.+ fractions of shale oil feed are shown in Table 3. More arsenic (43 ppm) is concentrated in the 650° F. fraction of the feed. Surprisingly, after $(NH_4)_2S$ solution treatment, about the same percentages of arsenic are removed from both the 650° F.− and 650°+ fractions of Paraho shale oil. Note that 78% dearsenation (deAs) occurs for run (K) compared to 78% deAs for the 650° F.− and 650° F+ fractions.

The 650° F.− fraction of the ammonium sulfide type solution extracted shale oil contains such low levels of arsenic contaminants that it could go directly to a hydrotreater. The 650° F.+ fraction, even after ammonium sulfide type solution treatment, would probably be passed through a guard bed before hydrotreating, but the guard bed would last about four times as long as a guard bed used to decontaminate non-arsenic extracted 650° F.+ shale oil.

In all the atmospheric pressure, low temperature (below 300° F.) ammonium sulfide treatments, nitrogen and sulfur level remain the same or increase slightly (probably due to $(NH_4)_2S$ traces in the shale oil). However, for the 500 psig, 500° F. hot tube contacting of $(NH_4)_2S$ solution and shale oil, approximately 6% denitrogenation (deN) occurs.

The appearance of the $(NH_4)_2S$ solution after extraction is the same as before, clear and yellow. Generally, about 10–20 ppm arsenic are found in these solutions, depending upon the experiment conducted. Arsenic material balances work out well (~90%). Any arsenic lost from the shale oil was accounted for by arsenic in the $(NH_4)_2$ S solution.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for removing contaminants from a hydrocarbonaceous fluid feed stream comprising the steps of:

(a) treating said feed stream at a tempeature of from about 20° F. to about 400° F. in the presence of an aqueous solution of ammonium sulfide type compounds for a time sufficient to convert at least some of the contaminants in said feed stream to components extractable in said aqueous solution; and (b) separating the aqueous solution containing said contaminants from the feed stream.

2. The process of claim 1 wherein said contaminants are arsenic and/or arsenic compounds.

3. The process of claim 1 wherein the separation step (b) is achieved by allowing the fluids to settle.

4. The process of claim 1 wherein said hydrocarbonaceous fluid feed stream comprises a crude, or fraction thereof, obtained from oil shale, solid coal, or tar sands.

5. The process of claim 1 wherein the ammonium sulfide type compounds consist essentially of $(NH_4)_2S$, $(NH_4)_2S_x$, $NH_4HS$, or any combination thereof.

6. The process of claim 1 wherein the aqueous solution of ammonium sulfide type compounds contains about 20 weight percent ammonium sulfide type compounds.

7. The process of claim 1 wherein the treated hydrocarbonaceous fluid contains less than 50 percent of the contaminants found in the untreated feed stream.

8. The process of claim 1 further comprising the steps of:

a. withdrawing from said treated feed stream a purified hydrocarbonaceous fluid having a reduced amount of contaminants; and b. subjecting the purified hydrocarbonaceous fluid to a catalytic hydrotreating process.

9. The process of claim 8 further comprising the step of recycling gaseous ammonia and hydrogen sulfide produced by the hydrotreating process to be utilized in forming the aqueous ammonium sulfide solution.

10. A process for removing arsenic contaminants from a hydrocarbonaceous fluid feed stream comprising the steps of:

(a) treating said feed stream at a temperature of at least 20° F. to about 400° F. in the presence of an aqueous solution containing a basic, non-metallic agent that will convert at least some of the arsenic in said feed stream to arsenic components extractable in said aqueous solution; and (b) separating the aqueous solution containing arsenic contaminants from the feed stream.

11. The process of claim 10, wherein said feed stream is heat treated at a temperature of from about 200° F. to 400° F.

12. The process of claim 10 wherein said hydrocarbonaceous fluid feed stream consists essentially of a crude, or fraction thereof, obtained from oil shale, solid coal, or tar sands.

13. The process of claim 10 wherein said agent is an ammonium sulfide type compound selected from the group consisting of $(NH_4)_2S$, $(NH_4)S_x$, $NH_4HS$, or any combination thereof.

14. The process of claim 13 wherein said aqueous solution contains about 20 weight percent of the ammonium sulfide type compound.

15. The process of claim 10 further comprising the steps of:

c. withdrawing from the treated feed stream a purified hydrocarbonaceous fluid having a reduced amount of arsenic contaminants; and d. subjecting the purified hydrocarbonaceous fluid to a catalytic hydrotreating process.

16. The process of claim 15 further comprising the step of recycling gaseous ammonia and hydrogen sulfide produced by the hydrotreating process to be utilized in forming the aqueous ammonium sulfide solution.

17. The process of claim 10 wherein the separation step (b) is achieved by allowing the fluids to settle.

18. A process for removing arsenic contaminants from a shale oil feed stream comprising the steps of:

(a) introducing the feed stream into a heat treatment extraction reactor zone;

(b) introducing aqueous ammonium sulfide solution into the extraction reactor zone;

(c) mixing the fluids while subjecting to heat treatment of from about 20° F. to about 400° F.; and (d) removing the treated fluids from the reactor zone into a settling zone where the fluids are allowed to settle and separate into two phases, an aqueous phase containing arsenic contaminants and an oil phase containing reduced amounts of arsenic contaminants.

19. The process of claim 18 further comprising the steps of:

e. removing the oil from the settling zone to a wash zone and subjecting said oil to at least one water wash to further remove arsenic contaminants; and f. transferring the dearsenated shale oil from the wash zone to a holding zone where any residual traces of ammonium sulfide are decomposed at low temperatures to gaseous ammonia and hydrogen sulfide.

20. The process of claim 19 further comprising the step of subjecting the dearsenated shale oil from the holding zone to a hydrotreating process.

21. The process of claim 20 further comprising the step of recycling gaseous ammonia and hydrogen sulfide produced by the hydrotreating process to be utilized in forming the aqueous ammonium sulfide solution.

* * * * *